US010746032B2

(12) United States Patent
Kucinskas

(10) Patent No.: US 10,746,032 B2
(45) Date of Patent: Aug. 18, 2020

(54) TRANSITION DUCT FOR A GAS TURBINE ENGINE

(71) Applicant: United Technologies Corporation, Farmington, CT (US)

(72) Inventor: Keith J. Kucinskas, West Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 479 days.

(21) Appl. No.: 15/491,067

(22) Filed: Apr. 19, 2017

(65) Prior Publication Data

US 2018/0306040 A1 Oct. 25, 2018

(51) Int. Cl.

| | |
|---|---|
| ***F01D 9/02*** | (2006.01) |
| ***F01D 25/16*** | (2006.01) |
| ***F01D 5/02*** | (2006.01) |

(52) U.S. Cl.

CPC ..... *F01D 9/023* (2013.01); *F01D 25/162* (2013.01); *F01D 5/026* (2013.01); *F05D 2220/3219* (2013.01)

(58) Field of Classification Search

CPC ..... F01D 9/023; F01D 5/026; F01D 25/162; F05D 2220/3219

See application file for complete search history.

(56) References Cited

U.S. PATENT DOCUMENTS

| | | | | |
|---|---|---|---|---|
| 2,528,635 | A * | 11/1950 | Bell | F02C 7/00 415/67 |
| 5,279,109 | A * | 1/1994 | Liu | F02C 7/052 60/39.092 |
| 6,799,112 | B1 * | 9/2004 | Carter | F01D 11/06 184/6.11 |
| 6,905,303 | B2 * | 6/2005 | Liu | F01D 5/26 29/889.22 |
| 7,517,192 | B2 * | 4/2009 | Hoeger | F01D 5/145 415/208.1 |
| 9,951,633 | B2 * | 4/2018 | Lord | F01D 9/02 |
| 10,012,108 | B2 * | 7/2018 | Amnell | F01D 25/162 |
| 10,287,992 | B2 * | 5/2019 | Tan | F02C 9/18 |
| 2007/0012046 | A1 * | 1/2007 | Larsson | F01D 1/02 60/791 |
| 2010/0170224 | A1 * | 7/2010 | Clark | F01D 5/143 60/264 |

(Continued)

FOREIGN PATENT DOCUMENTS

| | | |
|---|---|---|
| EP | 2535528 | 12/2012 |
| EP | 2847450 | 3/2015 |

(Continued)

OTHER PUBLICATIONS

EP Extended Search Report for EP Application No. EP18168347 dated Aug. 6, 2018.

*Primary Examiner* — Brian P Wolcott

(74) *Attorney, Agent, or Firm* — Carlson, Gaskey & Olds, P.C.

(57) ABSTRACT

A compressor section for a gas turbine engine includes an upstream portion that includes at least one upstream rotor stage. A downstream portion includes at least one downstream rotor stage configured to rotate with the upstream rotor stage. A transition duct separates the upstream portion from the downstream portion.

19 Claims, 2 Drawing Sheets

(56) References Cited

U.S. PATENT DOCUMENTS

| | | | | |
|---|---|---|---|---|
| 2010/0172747 | A1* | 7/2010 | Clark | F01D 5/143<br>415/177 |
| 2011/0000223 | A1* | 1/2011 | Russberg | F01D 9/041<br>60/796 |
| 2013/0272785 | A1 | 10/2013 | Pan | |
| 2016/0003099 | A1 | 1/2016 | Amnell et al. | |
| 2018/0023481 | A1* | 1/2018 | Lefebvre | F02C 3/113<br>415/124.1 |

FOREIGN PATENT DOCUMENTS

| | | |
|---|---|---|
| EP | 3018304 | 5/2016 |
| WO | 2014197155 | 12/2014 |

* cited by examiner

TRANSITION DUCT FOR A GAS TURBINE ENGINE

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

The compressor section and the turbine section each include rotor blades and vanes positioned in multiple arrays. During operation of the gas turbine engine, the arrays of rotor blades and vanes are subjected to rotational and thermal stresses. This is particularly true in the aft rotor stages of the compressor section, which experience high levels of heat due to the amount of compression taking place on the air passing through the compressor section. Therefore, the aft rotor stages of the compressor section may require cooling air to withstand the elevated temperatures of the compressed air. However, cooling the aft rotor stages requires cooling air to be bled off of the engine which decreases the efficiency of the gas turbine engine. Therefore, there is a need to improve the ability of the aft rotor stages of the compressor to withstand rotational loads and elevated air temperatures.

SUMMARY

In one exemplary embodiment, a compressor section for a gas turbine engine includes an upstream portion that includes at least one upstream rotor stage. A downstream portion includes at least one downstream rotor stage configured to rotate with the upstream rotor stage. A transition duct separates the upstream portion from the downstream portion.

In a further embodiment of any of the above, the transition duct include a transition duct inlet adjacent the upstream portion and a transition duct outlet adjacent the downstream portion.

In a further embodiment of any of the above, the transition duct outlet is spaced radially inward from the transition duct inlet relative to an axis of rotation of the compressor section.

In a further embodiment of any of the above, at least one upstream section vane array is located immediately upstream of the transition duct inlet.

In a further embodiment of any of the above, at least one downstream section vane array is located immediately downstream of the transition duct outlet.

In a further embodiment of any of the above, a radially outer edge of at least one upstream rotor stage is spaced radially outward from a radially outer edge of at least one downstream rotor stage.

In a further embodiment of any of the above, a platform on at least one rotor of the upstream rotor stage is spaced radially outward from a platform on at least one rotor of the downstream rotor stage.

In a further embodiment of any of the above, the upstream portion includes at least three upstream rotor stages.

In a further embodiment of any of the above, the downstream portion includes at least two downstream rotor stages.

In a further embodiment of any of the above, a bearing system is located axially downstream of the upstream portion and axially upstream of the downstream portion and radially inward from the transition duct.

In another exemplary embodiment, a gas turbine engine includes a turbine. A compressor is driven by the turbine through a spool. The compressor includes an upstream portion that includes at least one upstream rotor stage connected to the spool. A downstream portion includes at least one downstream rotor stage connected to the spool. A transition duct separates the upstream portion from the downstream portion.

In a further embodiment of any of the above, at least one upstream section vane array is located immediately upstream of the transition duct and at least one downstream section vane array is located immediately downstream of the transition duct.

In a further embodiment of any of the above, a radially outer edge of at least one upstream rotor stage is spaced radially outward from a radially outer edge of at least one downstream rotor stage.

In a further embodiment of any of the above, a platform on at least one rotor of at least one upstream rotor stage is spaced radially outward from a platform on at least one rotor of the downstream rotor stage.

In a further embodiment of any of the above, the spool includes a two piece shaft connected by a splined connection.

In a further embodiment of any of the above, a bearing system is located axially downstream of the upstream portion and axially upstream of the downstream portion for supporting the spool and radially inward from the transition duct.

In another exemplary embodiment, a method of operating a compressor section in a gas turbine engine comprising the steps of rotating at least one upstream rotor stage of the compressor section at the same rotational speed as at least one downstream rotor stage of the compressor section. A tip speed is reduced of at least one downstream rotor stage relative to a tip speed of at least one upstream rotor stage by locating a transition duct axially between at least one upstream rotor stage and at least one downstream rotor stage.

In a further embodiment of any of the above, a radially outer edge of at least one upstream rotor stage is spaced radially outward from a radially outer edge of at least one downstream rotor stage.

In a further embodiment of any of the above, air is directed into the transition duct with a first array of vanes located immediately upstream of the transition duct and direction air out of the transition duct with a second array of vanes located immediately downstream of the transition duct.

In a further embodiment of any of the above, a spool is supported driving at least one upstream rotor stage and at least one downstream rotor stage with a bearing system located axially between at least one upstream rotor stage and at least one downstream rotor stage and radially inward from the transition duct.

DETAILED DESCRIPTION

Figure 1:
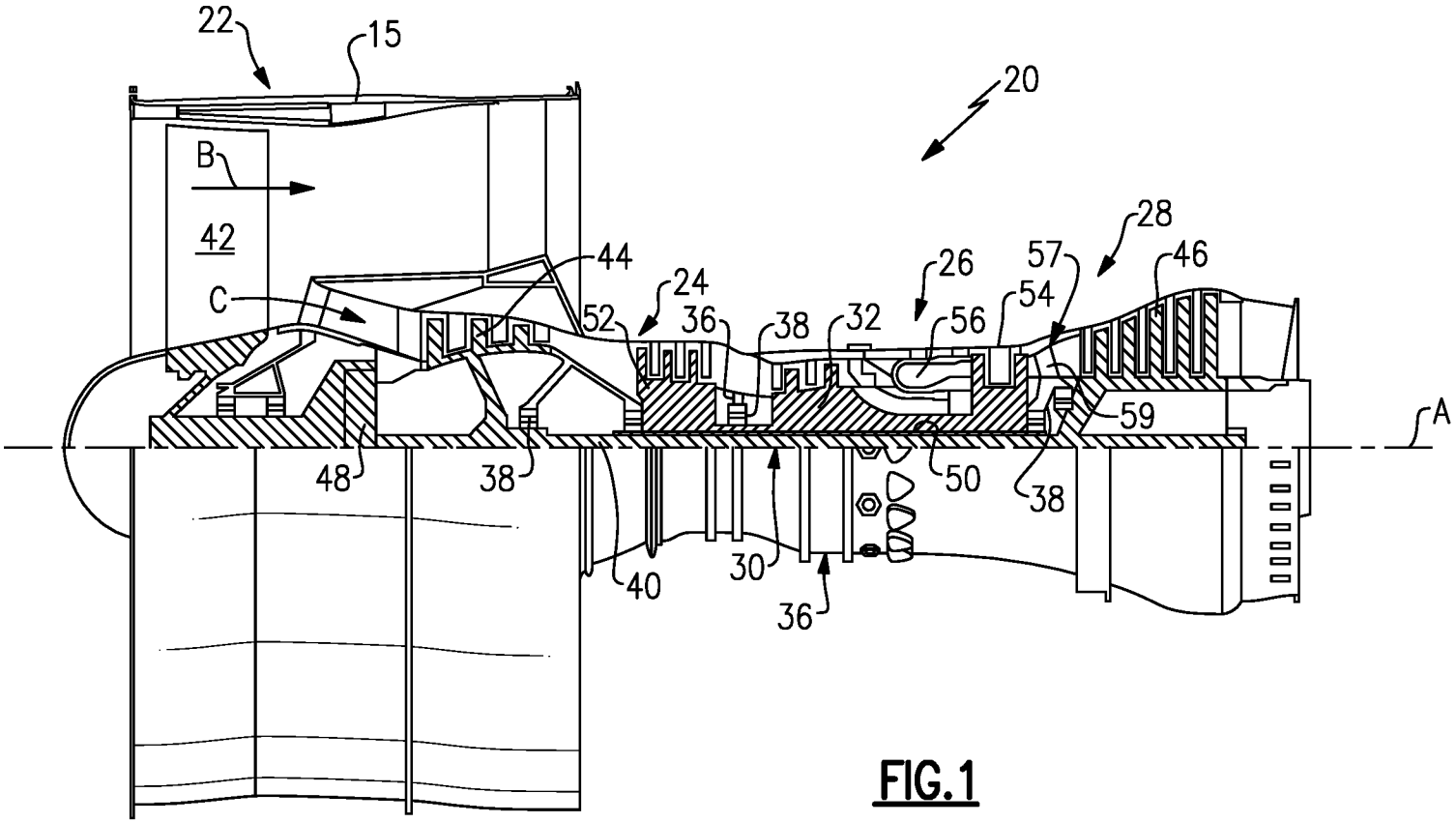
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core flow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\text{R})/(518.7^\circ\text{R})]^{\wedge 0.5}$. The "Low corrected fan tip speed" as disclosed herein according to one non-limiting embodiment is less than about 1150 ft/second.

Figure 2:
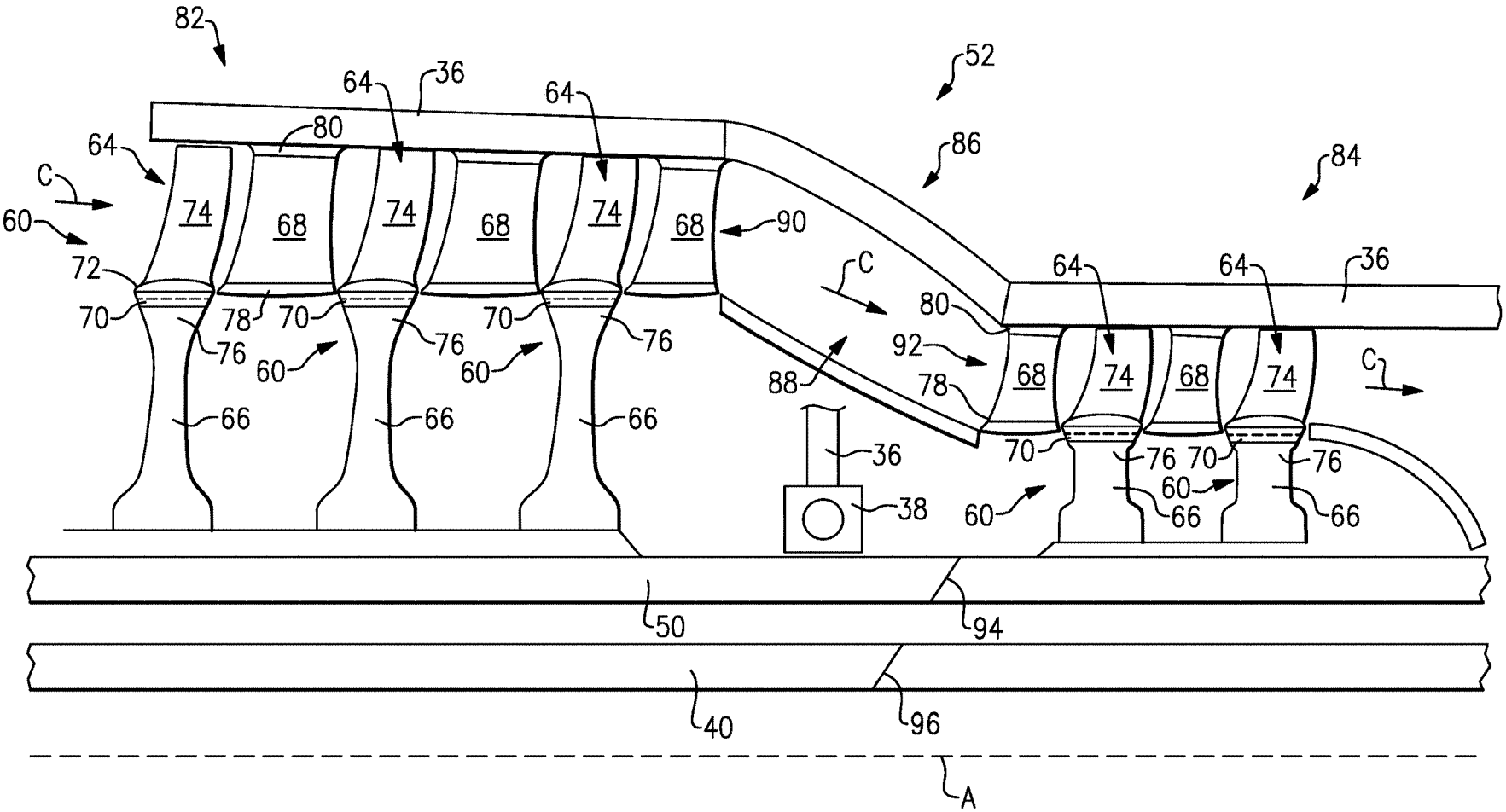
FIG. 2 is a schematic cross-sectional view of a high pressure compressor of the gas turbine engine of FIG. 1.

FIG. 2 is a schematic cross-sectional view of the high pressure compressor 52, however, other sections of the gas turbine engine 20 could benefit from this disclosure, such as the low pressure compressor 44 or the turbine section 28. In the illustrated non-limiting embodiment, the high pressure compressor 52 is a five stage compressor such that it includes five rotor stages 60. However, this disclose also applies to high pressure compressors 52 with more or less than five stages. Each of the rotor stages 60 in the high pressure compressor 52 rotate with the same shaft, which in this embodiment is the outer shaft 50.

Each of the rotor stages 60 includes rotor blades 64 arranged circumferentially in an array around a disk 66. Each of the rotor blades 64 includes a root portion 70, a platform 72, and an airfoil 74. The root portion 70 of each of the rotor blades 64 is received within a respective rim 76 of the disk 66. The airfoil 74 extends radially outward from the platform 72 to a free end at a radially outer edge. The free end of the airfoil 74 may be located adjacent a blade outer air seal (BOAS). In this disclosure, radial or radially is in relation to the engine axis A unless stated otherwise.

The rotor blades 64 are disposed in a core flow path C through the gas turbine engine 20. Due to the compression of the air in the core flow path C resulting from being compressed by each of the rotor stages 60 in the compressor section 24, the temperature of the air in the core flow path C becomes elevated as it passes through the high pressure compressor 52. The platform 72 on the rotor blades 64 also separates a hot gas core flow path side inclusive of the rotor blades 64 from a non-hot gas side inclusive of the root portion 70.

The vanes 62 are oriented into a circumferential array around the engine axis A. The circumferential array of vanes 62 are spaced axially along the engine axis A from the rotor stages 60. In this disclosure, axial or axially is in relation to the engine axis A unless stated otherwise. In the illustrated non-limiting embodiment, each vane 62 includes an airfoil 68 extending between a respective vane inner platform 78 and a vane outer platform 80 to direct the hot gas core flow path C past the vanes 62. The vanes 62 may be supported by the engine static structure 36 on a radially outer portion.

In the illustrated non-limiting embodiment, the high pressure compressor 52 includes an upstream portion 82 and a downstream portion 84. The upstream portion 82 is separated from the downstream portion 84 by a compressor transition case 86. The compressor transition case 86 defines a transition duct 88 between the upstream portion 82 and the downstream portion 84 and also spaces the upstream portion 82 axially from the downstream portion 84.

The transition duct 88 includes an inlet 90 adjacent the upstream portion 82 and an outlet 92 adjacent the downstream portion 84. The inlet 90 and the outlet 92 both form circumferential openings around the engine axis A. A radially inner edge of the inlet 90 is spaced further from the engine axis A than a radially inner edge of the outlet 92. Similarly, a radially outer edge of the inlet 90 is spaced a greater distance from the engine axis A than a radially outer edge of the outlet 92. The variation in distance of the inlet 90 and the outlet 92 relative to the engine axis A reduces the distance of the core flow path C from the engine axis A in the downstream portion 84 compared to the upstream portion 82.

By reducing the distance of the core flow path C from the engine axis A, a tip speed of the rotor blades 64 in the downstream portion 84 will be reduced when compared to a tip speed of the rotor blades 64 in the upstream portion 82. The tip speed of the rotor blades 64 is a significant factor in the overall stress experienced by the rotor blades 64 during operation. Another significant factor contributing to the amount of stress the rotor blades 64 can withstand is the temperature of the air in the core flow path C. However, with improved efficiency goals for gas turbine engines, the amount of compression performed is being increased, which leads to higher temperatures experiences by the rotor blades 64 in the compressor section 24. Therefore, the reduction in tip speed of the rotor blades 64 in the downstream portion 84, which generally experiences the highest air temperatures, reduces the stress on the rotor blades 64 in the downstream portion 84 such that the rotor blades 64 can withstand greater temperatures.

The reduction in stress experienced by the rotor blades 64 in the downstream portion 84 by reducing the tip speed of the rotor blades 64 improves the efficiency of the gas turbine engine 20. The improved efficiency results from a reduction in cooling needed for the aft rotor stages 60 of the downstream portion 84. Cooling of the aft rotor stages 60 can be reduced because the stress of the rotor blades 64 is reduced in the downstream portion 84 due to the reduced tip speed of the rotor blades 64 in the downstream portion 84. This reduction in cooling results in a reduction of cooling air being extracted from the compressor section 24 such that more of the air passing through the compressor section 24 can contribute to combustion and thrust generation.

In the illustrated non-limiting embodiment, one of the bearing systems 38 is located radially inward from the transition duct 88 and axially between the upstream portion 82 and the downstream portion 84. A radially inner side of the bearing system 38 supports the outer shaft 50 on a radially inner side of the bearing system 38 is supported by a portion of the engine static structure 36.

Additionally, the outer shaft 50 could include a splined connection 94 making the outer shaft 50 a two piece shaft. The splined connection 94 can contribute to improved assembly of the gas turbine engine 20. Similarly, the inner shaft 40 can include a splined connection 96 making the inner shaft 40 a two piece shaft, which also contributes to improved assembly of the gas turbine engine 20.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A compressor section for a gas turbine engine comprising:

an upstream portion including at least one upstream rotor stage;

a downstream portion including at least one downstream rotor stage configured to rotate with the at least one upstream rotor stage;

a transition duct separating the upstream portion from the downstream portion; and a first compressor supported for rotation by a first spool, wherein the upstream portion, the downstream portion, and the transition duct are located in a second compressor supported for rotation about a second spool concentrically arranged with the first spool.

2. The compressor section of claim 1, wherein the transition duct includes a transition duct inlet adjacent the upstream portion and a transition duct outlet adjacent the downstream portion.

3. The compressor section of claim 2, wherein the transition duct outlet is spaced radially inward from the transition duct inlet relative to an axis of rotation of the compressor section.

4. The compressor section of claim 2, further comprising at least one upstream section vane array located immediately upstream of the transition duct inlet.

5. The compressor section of claim 4, further comprising at least one downstream section vane array located immediately downstream of the transition duct outlet.

6. The compressor section of claim 1, wherein a radially outer edge of the at least one upstream rotor stage is spaced radially outward from a radially outer edge of the at least one downstream rotor stage.

7. The compressor section of claim 6, wherein a platform on at least one rotor of the at least one upstream rotor stage is spaced radially outward from a platform on the at least one downstream rotor stage.

8. The compressor section of claim 1, wherein the upstream portion includes at least three upstream rotor stages.

9. The compressor section of claim 8, wherein the downstream portion includes at least two downstream rotor stages.

10. The compressor section of claim 1, further comprising a bearing system located axially downstream of the upstream portion and axially upstream of the downstream portion and radially inward from the transition duct.

11. A gas turbine engine comprising:

a turbine section including a first turbine and a second turbine;

a compressor section including a first compressor connected to the first turbine through a first spool and a second compressor connected to the second turbine through a second spool concentric with the first spool, the second compressor driven by the second turbine through the second spool, the second compressor including:

an upstream portion including at least one upstream rotor stage connected to the second spool;

a downstream portion including at least one downstream rotor stage connected to the second spool; and a transition duct separating the upstream portion from the downstream portion.

12. The gas turbine engine of claim 11, further comprising at least one upstream section vane array located immediately upstream of the transition duct and at least one downstream section vane array located immediately downstream of the transition duct, wherein the second turbine is a high pressure turbine, the second compressor is a high pressure compressor, and the second spool is a high speed spool.

13. The gas turbine engine of claim 11, wherein a radially outer edge of the at least one upstream rotor stage is spaced radially outward from a radially outer edge of the at least one downstream rotor stage.

14. The gas turbine engine of claim 13, wherein a platform on at least one rotor of the at least one upstream rotor stage is spaced radially outward from a platform on at least one rotor of the at least one downstream rotor stage.

15. The gas turbine engine of claim 11, wherein the second spool includes a two piece shaft connected by a splined connection and the second spool is a high speed spool with the at least one upstream rotor stage and the at least one downstream rotor stage configured to rotate together on the high speed spool.

16. The gas turbine engine of claim 11, further comprising a bearing system located axially downstream of the upstream portion and axially upstream of the downstream portion for supporting the second spool and radially inward from the transition duct.

17. A method of operating a compressor section in a gas turbine engine comprising the steps of:

rotating at least one upstream rotor stage of the compressor section at the same rotational speed as at least one downstream rotor stage of the compressor section;

reducing a tip speed of the at least one downstream rotor stage relative to a tip speed of the at least one upstream rotor stage by locating a transition duct axially between the at least one upstream rotor stage and the at least one downstream rotor stage;

supporting a spool driving the at least one upstream rotor stage and the at least one downstream rotor stage with a bearing system located axially between the at least one upstream rotor stage and the at least one downstream rotor stage and radially inward from the transition duct, wherein the spool is concentrically mounted around another spool.

18. The method of claim 17, wherein a radially outer edge of the at least one upstream rotor stage is spaced radially outward from a radially outer edge of the at least one downstream rotor stage, wherein the at least one upstream rotor stage and the at least one downstream rotor stage are connected to a single spool.

19. The method of claim 17, further comprising directing air into the transition duct with a first array of vanes located immediately upstream of the transition duct and directing air out of the transition duct with a second array of vanes located immediately downstream of the transition duct, wherein the at least one upstream rotor stage and the at least one downstream rotor stage are connected to a single spool.

* * * * *